US011794870B2

(12) United States Patent
Igarashi

(10) Patent No.: US 11,794,870 B2
(45) Date of Patent: Oct. 24, 2023

(54) HELM DEVICE

(71) Applicant: NHK SPRING CO., LTD., Yokohama (JP)

(72) Inventor: Daisuke Igarashi, Yokohama (JP)

(73) Assignee: NHK SPRING CO., LTD., Kanagawa (JP)

( * ) Notice: Subject to any disclaimer, the term of this patent is extended or adjusted under 35 U.S.C. 154(b) by 0 days.

(21) Appl. No.: 18/160,676

(22) Filed: Jan. 27, 2023

(65) Prior Publication Data

US 2023/0166822 A1 Jun. 1, 2023

Related U.S. Application Data

(63) Continuation of application No. PCT/JP2021/027123, filed on Jul. 20, 2021.

(30) Foreign Application Priority Data

Jul. 30, 2020 (JP) ..... 2020-129045

(51) Int. Cl.
*B63H 20/10* (2006.01)
*B63H 20/12* (2006.01)

(52) U.S. Cl.
CPC ..... *B63H 20/10* (2013.01); *B63H 20/12* (2013.01)

(58) Field of Classification Search
CPC ..... B63H 20/10; B63H 20/12
See application file for complete search history.

(56) References Cited

U.S. PATENT DOCUMENTS 2,826,090 A * 3/1958 Grinnell ..... B63H 25/08 74/480 B
6,055,922 A 5/2000 Madachi et al.
6,202,584 B1 3/2001 Madachi et al.
10,011,340 B2 7/2018 Gai et al.
2007/0278777 A1 12/2007 Liu et al.
(Continued)

FOREIGN PATENT DOCUMENTS

JP H10236393 A 9/1998
JP H11222197 A 8/1999
JP 2000043794 A 2/2000
(Continued)

OTHER PUBLICATIONS

Decision to Grant a Patent (and English translation thereof) dated Dec. 6, 2022, issued in counterpart Japanese Application No. 2020-129045.

(Continued)

*Primary Examiner* — Stephen P Avila
(74) *Attorney, Agent, or Firm* — Holtz, Holtz & Volek PC

(57) ABSTRACT

In an embodiment, a helm device comprises a steering shaft extending in a first direction, a housing, a tilt base, a pair of tilt mechanisms which supports the housing to make the housing rotatable with respect to the tilt base about a tilt axis, and a lock mechanism which fixes an angle of the steering shaft. Each of the pair of tilt mechanisms comprises a shaft member projecting from a side portion of the housing, a bracket provided on the tilt base and comprising a hole portion into which the shaft member is inserted rotatably, and a bushing disposed between the shaft member and the hole portion.

10 Claims, 8 Drawing Sheets

(56) References Cited

U.S. PATENT DOCUMENTS

| | | | |
|---|---|---|---|
| 2015/0166161 | A1 | 6/2015 | Washino |
| 2016/0236703 | A1 | 8/2016 | Kuwabara |

FOREIGN PATENT DOCUMENTS

| | | | |
|---|---|---|---|
| JP | 2005104281 | A | 4/2005 |
| JP | 2006069464 | A | 3/2006 |
| JP | 2007320549 | A | 12/2007 |
| JP | 2014054961 | A | 3/2014 |
| JP | 2016147627 | A | 8/2016 |

OTHER PUBLICATIONS

International Search Report (ISR) (and English language translation thereof) dated Sep. 21, 2021, issued in International Application No. PCT/JP2021/027123.

Japanese Office Action (and English language translation thereof) dated Oct. 4, 2022, issued in counterpart Japanese Application No. 2020-129045.

* cited by examiner

HELM DEVICE

CROSS-REFERENCE TO RELATED APPLICATIONS

This application is a Continuation Application of PCT Application No. PCT/JP2021/027123, filed Jul. 20, 2021 and based upon and claiming the benefit of priority from prior Japanese Patent Application No. 2020-129045, filed Jul. 30, 2020, the entire contents of all of which are incorporated herein by reference.

BACKGROUND OF THE INVENTION

1. Field of the Invention

The present invention relates to a helm device used to steer a boat.

2. Description of the Related Art

Conventionally, as a steering device for changing the steering angle of an outboard motor, a steering device which transmits the rotation of a steering shaft coupled to a steering wheel (helm) to an actuator of the outboard motor by a hydraulic pipe or a push-pull cable has been known. In addition, there is also an electric steering device which detects the rotation of the steering shaft by a sensor and drives the actuator of the outboard motor on the basis of an electrical signal output by the sensor.

In general, the steering shaft is tilted at a predetermined tilt angle to a horizontal direction. To achieve comfortable operability for a boat operator, the tilt angle of the helm device including the steering shaft should preferably be adjustable. For example, as a prior art which enables such adjustment, a steering device disclosed in U.S. Pat. No. 10,011,340 B2 (Patent Literature 1) has been known.

There's room for various improvements in the functionality and operability of a conventional helm device which can adjust the tilt angle of a steering shaft including the structure disclosed in Patent Literature 1. Thus, one of the objects of the present invention is to provide a helm device which can adjust the tilt angle of a steering shaft and which has excellent functionality and operability.

BRIEF SUMMARY OF THE INVENTION

According to an embodiment, a helm device comprises: a steering shaft extending in a first direction; a housing in which part of the steering shaft is housed; a tilt base mounted on a hull; a pair of tilt mechanisms which supports the housing to make the housing rotatable with respect to the tilt base about a tilt axis parallel to a second direction crossing the first direction; and a lock mechanism which fixes an angle of the steering shaft with respect to the tilt base by stopping the housing from being rotated by the pair of tilt mechanisms. Each of the pair of tilt mechanisms comprises: a shaft member projecting from a side portion of the housing crossing the tilt axis; a bracket provided on the tilt base and comprising a hole portion into which the shaft member is inserted rotatably; and a bushing disposed between an outer circumferential surface of the shaft member and an inner circumferential surface of the hole portion.

The tilt base may comprise an opening, the housing may be passed through the opening, the bracket may project from the tilt base toward a front end portion of the steering shaft, and the tilt axis may be located between the tilt base and the front end portion of the steering shaft in the first direction.

Each of the pair of tilt mechanisms may further comprise a first urging member which urges the housing in a predetermined rotation direction around the tilt axis. In this case, the first urging member may comprise a coil portion through which the shaft member is passed, an arm on a fixed-point side which extends from the coil portion and which is supported by the tilt base, and an arm on a point-of-action side which extends from the coil portion and which is supported by the housing.

The lock mechanism may comprise: slots on an outer surface of the housing which are arranged in a circumferential direction around the tilt axis; and a lever comprising a latch which is insertable into the slots. In this case, when the latch is inserted into any one of the slots, the housing may be stopped from being rotated by the pair of tilt mechanisms.

The lock mechanism may further comprise: a pin which couples the lever to the tilt base to make the lever rotatable about an axis parallel to the tilt axis; and a second urging member which urges the lever to press the latch against the slots. In this case, the second urging member may comprise a coil portion through which the pin is passed, an arm on a fixed-point side which extends from the coil portion and which is supported by the tilt base, and an arm on a point-of-action side which extends from the coil portion and which is supported by the lever.

Each of the pair of tilt mechanisms may further comprise: a first stopper and a second stopper provided on the housing around the shaft member and arranged in a circumferential direction around the tilt axis; and a third stopper and a fourth stopper provided on the bracket and arranged concentrically with the first stopper and the second stopper. Moreover, when the housing is rotated in a first rotation direction around the tilt axis and a tilt of the steering shaft thereby reaches a first critical angle, the first stopper and the third stopper may be brought into contact with each other and the housing may be stopped from further rotating in the first rotation direction, and when the housing is rotated in a second rotation direction opposite to the first rotation direction and the tilt of the steering shaft thereby reaches a second critical angle, the second stopper and the fourth stopper may be brought into contact with each other and the housing may be stopped from further rotating in the second rotation direction.

The lock mechanism may further comprise a fifth stopper and a sixth stopper located at ends of the slots in a circumferential direction around the tilt axis, respectively. Moreover, in a state where the latch is retracted from the slots, when the housing is rotated in a first rotation direction about the tilt axis and a tilt of the steering shaft thereby reaches a first critical angle, the fifth stopper and the latch may be brought into contact with each other and the housing may be stopped from further rotating in the first rotation direction, and in a state where the latch is retracted from the slots, when the housing is rotated in a second rotation direction opposite to the first rotation direction and the tilt of the steering shaft thereby reaches a second critical angle, the sixth stopper and the latch may be brought into contact with each other and the housing may be stopped from further rotating in the second rotation direction.

An end portion of the steering shaft located inside the housing may overlap the shaft member in a direction parallel to the tilt axis.

The helm device may further comprise an electromagnetic brake which is housed in the housing and which gives resistance to the steering shaft.

The housing may comprise a front end portion through which the steering shaft extends and a back end portion located opposite to the front end portion in the first direction. Moreover, the shaft member may be located closer to the back end portion than the electromagnetic brake in the first direction.

The helm device may further comprise: a first circuit board on which a sensor is mounted, the sensor detecting rotation of the steering shaft; and a second circuit board on which a power supply circuit is mounted, the power supply circuit supplying power to the first circuit board. Moreover, the first circuit board may overlap the shaft member in the second direction, and the second circuit board may be located between the first circuit board and the back end portion in the first direction.

The housing may comprise: a housing base comprising a first end portion in the first direction, a second end portion opposite to the first end portion, and the shaft member of each of the pair of tilt mechanisms; a housing top coupled to the first end portion of the housing base and provided with an opening through which the steering shaft is passed; and a cover coupled to the second end portion of the housing base. In this case, the housing base and the housing top may form a first chamber in which part of the steering shaft and the electromagnetic brake are housed, the housing base and the cover may form a second chamber in which the first circuit board and the second circuit board are housed, and the second chamber may overlap the shaft member in the second direction.

The present invention can provide a helm device which can adjust the tilt angle of a steering shaft and which has excellent functionality and operability.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

One of the embodiments of the present invention will be described with reference to the drawings.

Figure 1:
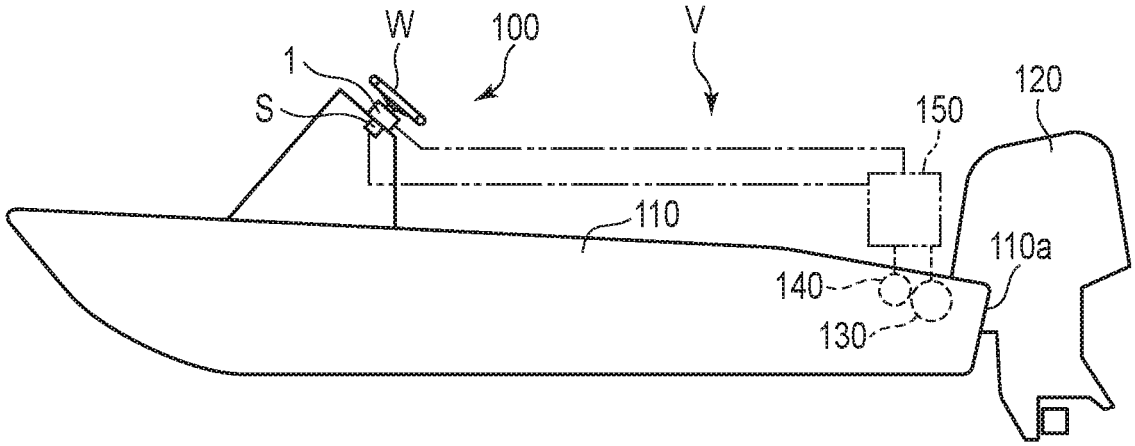
FIG. 1 is a schematic side view of a boat on which a steering device is mounted according to an embodiment.
Figure 2:
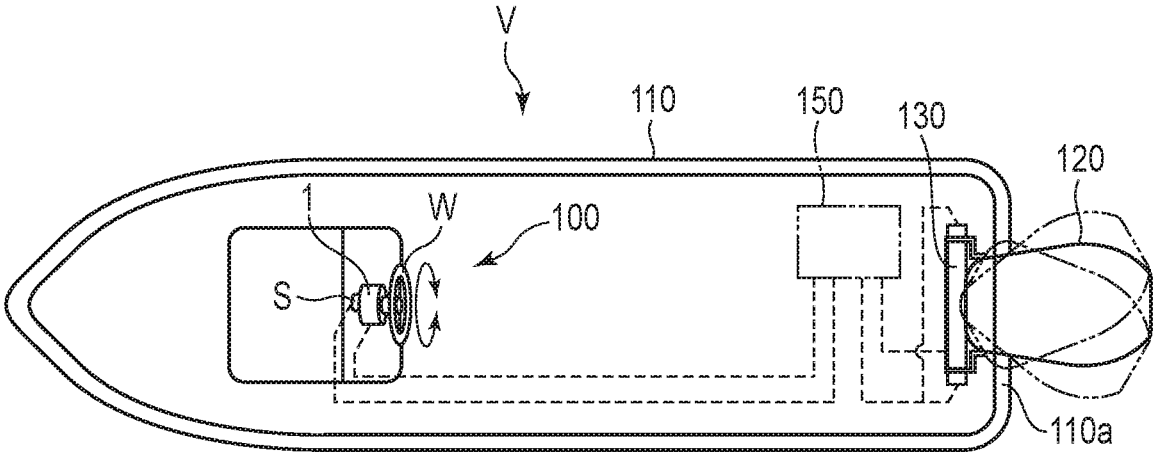
FIG. 2 is a schematic plan view of the boat shown in FIG. 1.

FIG. 1 is a schematic side view of a boat V on which a steering device is mounted according to the present embodiment. FIG. 2 is a schematic plan view of the boat V shown in FIG. 1. The boat V comprises a steering device 100, a hull 110, and an outboard motor 120.

The steering device 100 comprises a helm device 1 comprising a steering wheel W and a sensor S for detecting the amount of rotation (steering angle) of the steering wheel W, an electric actuator 130 which changes the steering angle of the outboard motor 120, a steering angle sensor 140 which detects the steering angle of the outboard motor 120, and a control unit 150. The control unit 150 is electrically connected to the helm device 1, the actuator 130, and the steering angle sensor 140. The outboard motor 120 comprises a screw which gives propulsive power to the boat V and is mounted on, for example, a rear wall 110*a* of the hull 110.

When the steering wheel W is rotated, the amount of rotation of the steering wheel W is detected by the sensor S of the helm device 1, and an electrical signal relating to the direction of the steering angle and the magnitude of the steering angle is transmitted to the control unit 150. The control unit 150 drives the actuator 130 to make a target steering angle set on the basis of information acquired from the sensor S and the actual steering angle of the outboard motor 120 detected by the steering angle sensor 140 agree with each other.

Figure 3:
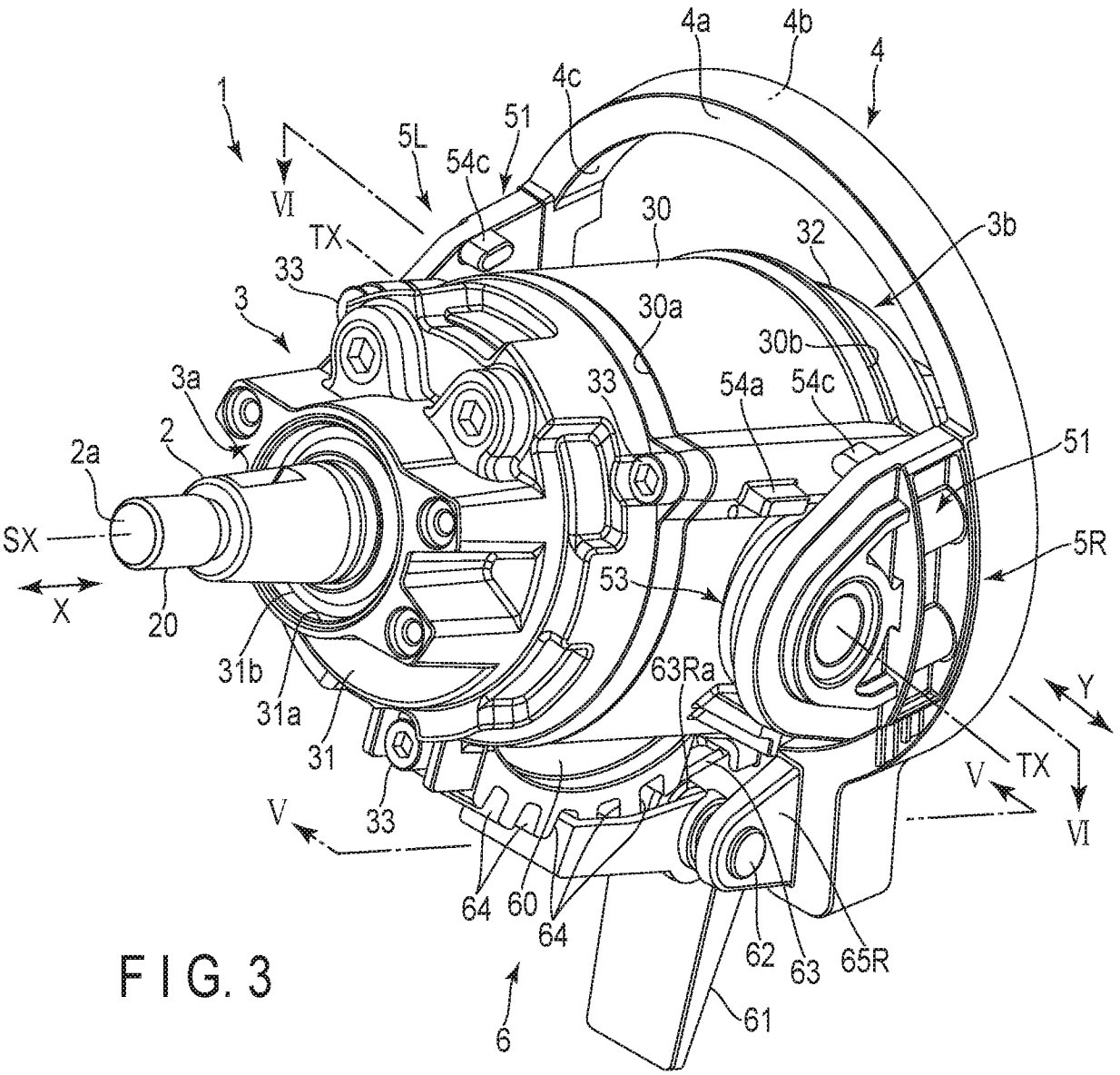
FIG. 3 is a schematic perspective view of a helm device according to the embodiment.

FIG. 3 is a schematic perspective view of the helm device 1. The helm device 1 comprises a steering shaft 2, a housing 3, a tilt base 4, a pair of tilt mechanisms 5R and 5L, and a lock mechanism 6.

The steering shaft 2 has a shape long in a first direction X and comprises a mounting portion 20 on which the steering wheel W is mounted in the vicinity of a front end portion 2*a*. Part of the steering shaft 2 is housed in the housing 3. The steering shaft 2 is rotatable about a shaft axis SX parallel to the first direction X.

The housing 3 comprises a front end portion 3*a* in the first direction X and a back end portion 3*b* opposite to the front end portion 3*a*. The steering shaft 2 extends through the front end portion 3*a*. In the present embodiment, the housing 3 is composed of a housing base 30, a housing top 31 including the front end portion 3*a*, and a cover 32 including the back end portion 3*b*. For example, the housing base 30 and the housing top 31 are formed of metallic materials and the cover 32 is formed of a resin material.

The housing base 30 is, for example, cylindrical and comprises a first end portion 30*a* in the first direction X and a second end portion 30*b* opposite to the first end portion 30*a*. The housing top 31 is coupled to the first end portion 30*a* by coupling members 33 which are, for example, bolts. Similarly, the cover 32 is coupled to the second end portion 30*b* by coupling members which are, for example, bolts.

The housing top 31 comprises an opening 31*a* for passing the steering shaft 2 at the front end portion 3*a*. The gap between the inner wall of the opening 31*a* and the steering shaft 2 is closed by a lid member 31*b*.

The tilt base 4 comprises a first side surface 4*a* in the first direction X, a second side surface 4*b* opposite to the first side surface 4*a*, and an opening 4*c* reaching from the first side surface 4*a* to the second side surface 4*b*. In the example of FIG. 3, the housing 3 is passed through the opening 4*c*. Most of the housing 3 is located closer to the front end portion 2*a* of the steering shaft 2 than the first side surface 4*a*. For example, in a state where the second side surface 4*b* is brought into contact with the mounting position of the helm device 1 in the hull 110, the tilt base 4 is fixed at the mounting position by an appropriate means such as fastening by bolts.

The tilt mechanisms 5R and 5L support the housing 3 to make the housing 3 rotatable with respect to the tilt base 4 about a tilt axis TX parallel to a second direction Y crossing the first direction X. In the present embodiment, the first direction X and the second direction Y are orthogonal.

Figure 4:
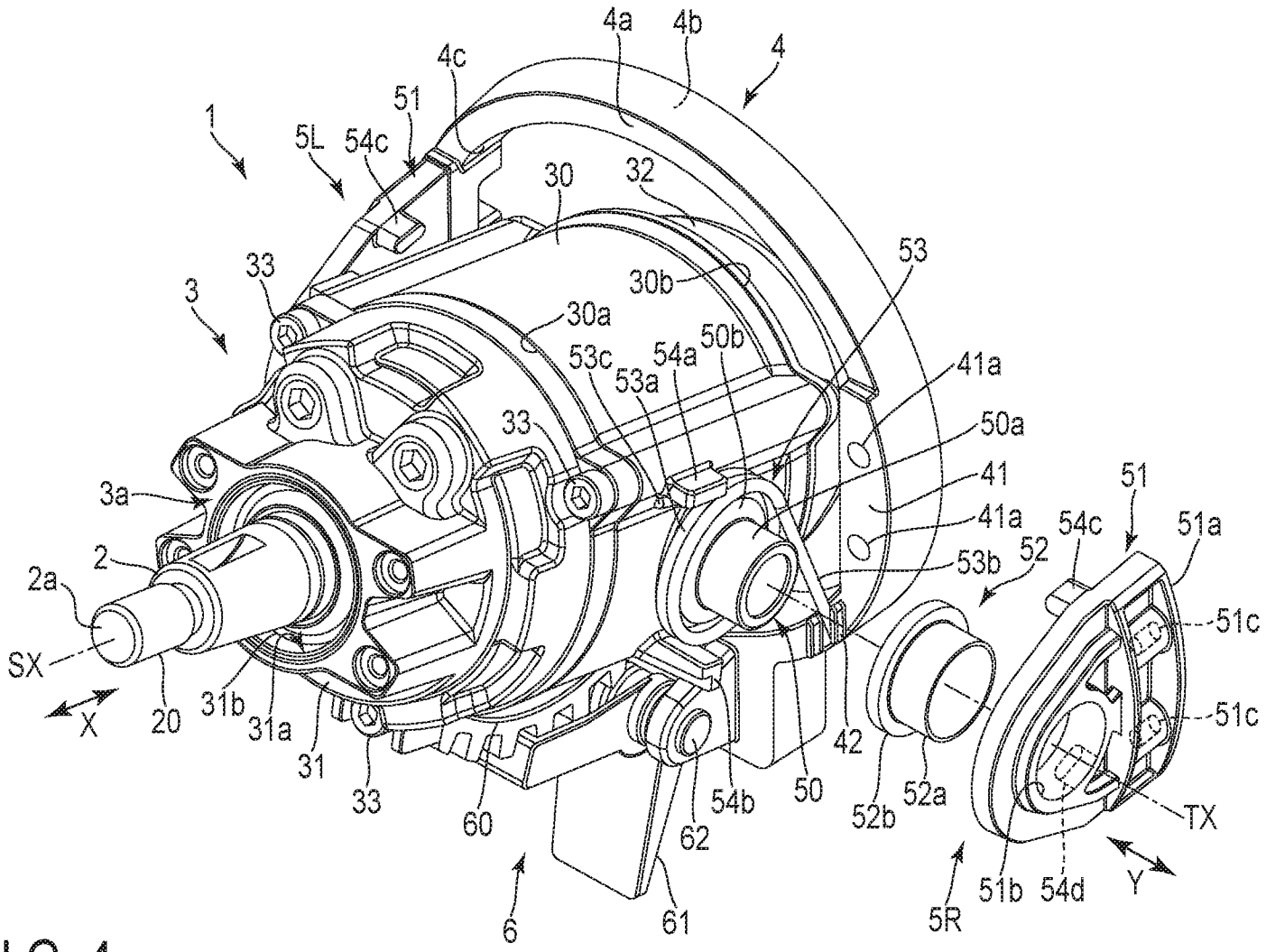
FIG. 4 is a schematic perspective view of the helm device in a state where a tilt mechanism shown in FIG. 3 is disassembled.

FIG. 4 is a schematic perspective view of the helm device 1 in a state where the tilt mechanism 5R is disassembled. The tilt mechanism 5R comprises a shaft member 50, a bracket 51, a bushing 52, and a first urging member 53.

The shaft member 50 is provided at a side portion of the housing 3 (side portion of the housing base 30) which crosses the tilt axis TX. In the example of FIG. 4, the shaft member 50 comprises a cylindrical first portion 50*a* having its center on the tilt axis TX and a circular second portion 50*b* having its center on the tilt axis TX. The diameter of the outer circumferential surface of the second portion 50*b* is larger than the diameter of the outer circumferential surface of the first portion 50*a*. The second portion 50*b* is located between the first portion 50*a* and the housing base 30. In the present embodiment, the first portion 50*a* and the second portion 50*b* are formed integrally with the housing base 30. However, the first portion 50*a* and the second portion 50*b* may be coupled to the housing base 30 by an appropriate means such as screwing.

The bracket 51 comprises a mounting surface 51*a* on the tilt base 4 side and a circular hole portion 51*b* having its center on the tilt axis TX. In the example of FIG. 4, the hole portion 51*b* is an opening which penetrates the bracket 51 in the second direction Y, but the hole portion 51*b* may be a recess having a bottom. The inside diameter of the hole portion 51*b* is larger than the outside diameter of the first portion 50*a* of the shaft member 50.

The tilt base 4 comprises a base portion 41 on the first side surface 4*a* side. The base portion 41 is provided with a pair of mounting holes 41*a* which penetrates to the second side surface 4*b*. On the mounting surface 51*a* of the bracket 51, female screws 51*c* are provided at positions facing the mounting holes 41*a*. The bracket 51 is coupled to the tilt base 4 by bringing the mounting surface 51*a* into contact with the base portion 41 and screwing bolts into the female screws 51*c* through the mounting holes 41*a*, respectively.

The bushing 52 comprises a cylindrical first portion 52*a* having its center on the tilt axis TX and a cylindrical second portion 52*b* similarly having its center on the tilt axis TX. The inside diameter of the first portion 52*a* is larger than the outside diameter of the first portion 50*a* of the shaft member 50, and the outside diameter of the first portion 52*a* is smaller than the inside diameter of the hole portion 51*b* of the bracket 51. The outside diameter of the second portion 52*b* is larger than the inside diameter of the hole portion 51*b*.

Around the shaft member 50, a first stopper 54*a* and a second stopper 54*b* projecting in the second direction Y are provided on the outer surface of the housing base 30. The first stopper 54*a* and the second stopper 54*b* are arranged in a circumferential direction having its center on the tilt axis TX. A gap is provided between the first and second stoppers 54*a* and 54*b* and the second portion 50*b* of the shaft member 50.

A third stopper 54*c* and a fourth stopper 54*d* projecting in the second direction Y are provided on a surface facing the housing base 30 of the bracket 51. In a state where the tilt mechanism 5R is assembled, the third stopper 54*c* and the fourth stopper 54*d* are arranged concentrically with the first stopper 54*a* and the second stopper 54*b*.

The first urging member 53 is, for example, a torsion spring and comprises a coil portion 53*a* which is a spirally wound wire and a pair of arms 53*b* and 53*c* which extends from the coil portion 53*a*. The shaft member 50 is passed through the coil portion 53*a*. The coil portion 53*a* is located between the second portion 50*b* and the stoppers 54*a* and 54*b*.

The arm 53*b* is held by a holding portion 42 provided on the tilt base 4. The arm 53*c* contacts the lower surface (surface on the shaft member 50 side) of the first stopper 54*a*. The portion held by the holding portion 42 of the arm 53*b* corresponds to a fixed point of the first urging member 53. The portion which contacts the first stopper 54*a* of the arm 53*c* corresponds to a point of action of the first urging member 53.

In a state where the tilt mechanism 5R is assembled as shown in FIG. 3, the first portion 50*a* of the shaft member 50 is inserted into the bushing 52, and the first portion 52*a* of the bushing 52 is inserted into the hole portion 51*b* of the bracket 51. At this time, in a radial direction having its center on the tilt axis TX, the first portion 52*a* of the bushing 52 is interposed between the first portion 50*a* of the shaft member 50 and the inner wall of the hole portion 51*b*. Moreover, in the second direction Y, the second portion 52*b* of the bushing 52 is interposed between the second portion 50*b* of the shaft member 50 and the peripheral portion of the hole portion 51*b* of the bracket 51.

The tilt mechanism 5L has the same structure as the tilt mechanism 5R. Accordingly, the housing 3 is supported by the tilt mechanisms 5R and 5L and is rotatable about the tilt axis TX with respect to the tilt base 4.

In a state where the tilt mechanisms 5R and 5L are assembled as shown in FIG. 3, each of the brackets 51 projects from the tilt base 4 toward the front end portion 2*a* of the steering shaft 2. In the first direction X, the tilt axis TX is located between the tilt base 4 and the front end portion 2*a* of the steering shaft 2.

The center of gravity of the main body of the helm device 1 including the steering shaft 2 and the housing 3, which is supported by the tilt mechanisms 5R and 5L, is located closer to the front end portion 2*a* of the steering shaft 2 than the tilt axis TX. Thus, in a state where the fixing of the housing 3 by the lock mechanism 6 is released, which will be described later, the housing 3 can rotate to cause the shaft axis SX to point downward in FIG. 3 and FIG. 4. The first urging member 53 has the function of restraining such rotation. That is, the first urging member 53 urges the housing 3 to cause the shaft axis SX to point upward in FIG. 3 and FIG. 4.

Figure 5:
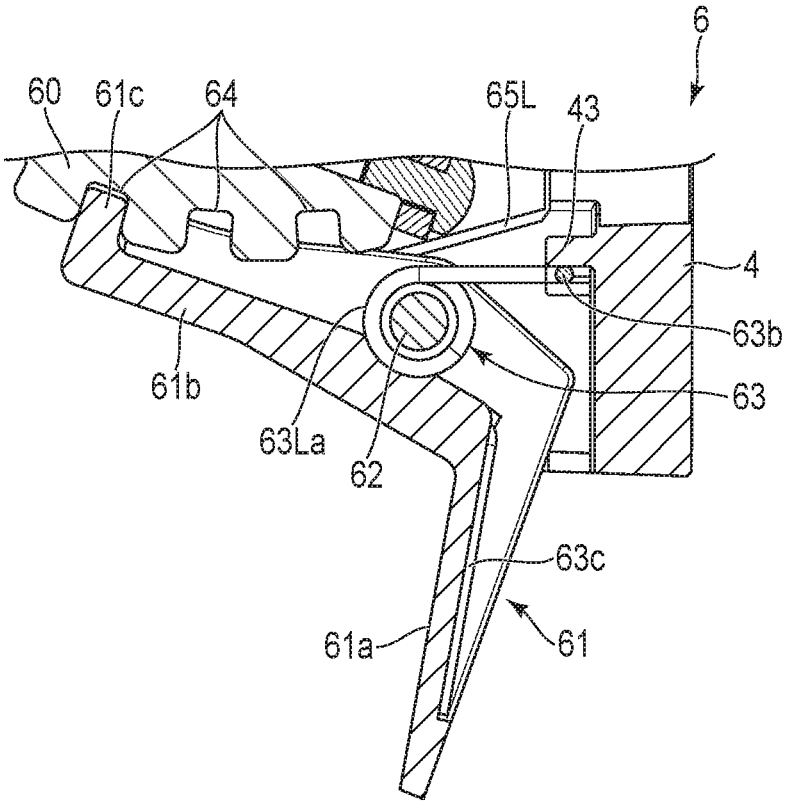
FIG. 5 is a schematic partial cross-sectional view of the helm device along line V-V in FIG. 3.

FIG. 5 is a schematic partial cross-sectional view of the helm device 1 along line V-V in FIG. 3. The structure of the lock mechanism 6 will be described hereinafter with reference to FIG. 3 and FIG. 5.

As shown in FIG. 3, the lock mechanism 6 comprises an arcuate portion 60 provided at the lower part of the housing 3, a lever 61, a pin 62, and a second urging member 63.

The arcuate portion 60 is, for example, formed integrally with the housing base 30, and has an arcuate outer circumferential surface having its center on the tilt axis TX. The outer circumferential surface is provided with slots 64 (grooves). The slots 64 extend parallel to the tilt axis TX and are arranged at regular intervals in a circumferential direction having its center on the tilt axis TX. In the example of FIG. 3, the arcuate portion 60 comprises the five slots 64, but the number of slots 64 may be four or less or may be six or greater.

The tilt base 4 comprises a pair of holding portions 65R and 65L for holding the lever 61. The holding portion 65R is shown in FIG. 3 and the holding portion 65L is shown in FIG. 5. The shapes of the holding portions 65R and 65L are the same, and both of them project from the first side surface 4*a* in the lower part of the tilt base 4.

The lever 61 is made of, for example, metal and is located between the holding portions 65R and 65L. The pin 62 is parallel to the tilt axis TX and is passed through each hole provided in the holding portions 65R and 65L and the lever 61. The lever 61 is thereby coupled to the tilt base 4 to be rotatable about an axis parallel to the tilt axis TX.

As shown in FIG. 5, the lever 61 comprises an operation portion 61*a* extending downward from the vicinity of the pin 62 and an action portion 61*b* extending toward the arcuate portion 60 from the vicinity of the pin 62. The operation portion 61*a* and the action portion 61*b* form a substantially L-shape. The operation portion 61*a* is a portion for a user to operate (push) by hand. At the front end of the action portion 61*b*, a latch 61*c* which is insertable into and removable from the slots 64 is provided. The operation portion 61*a* may be covered by a cover formed of, for example, resin or rubber. Such a cover may be attachable to and detachable from the operation portion 61*a*.

The second urging member 63 is, for example, a torsion spring and comprises a pair of coil portions 63Ra and 63La which is spirally wound wires, an arm 63*b* extending from the coil portions 63Ra and 63La and connecting the coil portions 63Ra and 63La, and arms 63*c* extending from the coil portions 63Ra and 63La, respectively. The coil portion 63Ra is shown in FIG. 3 and the coil portion 63La is shown in FIG. 5. The pin 62 is passed through the coil portions 63Ra and 63La.

The arm 63*b* is supported by a support portion 43 provided on the tilt base 4. The arms 63*c* extending from the coil portions 63Ra and 63La, respectively, contact the back surface of the operation portion 61*a*. The portion supported by the support portion 43 of the arm 63*b* corresponds to a fixed point of the second urging member 63. The portion which contacts the back surface of the operation portion 61*a* of each of the arms 63*c* corresponds to a point of action of the second urging member 63.

The second urging member 63 always urges the lever 61 to press the latch 61*c* against the arcuate portion 60. Thus, when the operation portion 61*a* is not pushed, the latch 61*c* keeps being inserted into the slots 64 as shown in FIG. 5. At this time, the rotation of the housing 3 by the tilt mechanisms 5R and 5L is prevented.

For example, in the state shown in FIG. 5, when the operation portion 61*a* is pushed to the right in the figure against the urging force of the second urging member 63, the lever 61 rotates about the pin 62 and the latch 61*c* comes out of the slots 64. At this time, the housing 3 becomes rotatable about the tilt axis TX.

Figure 6:
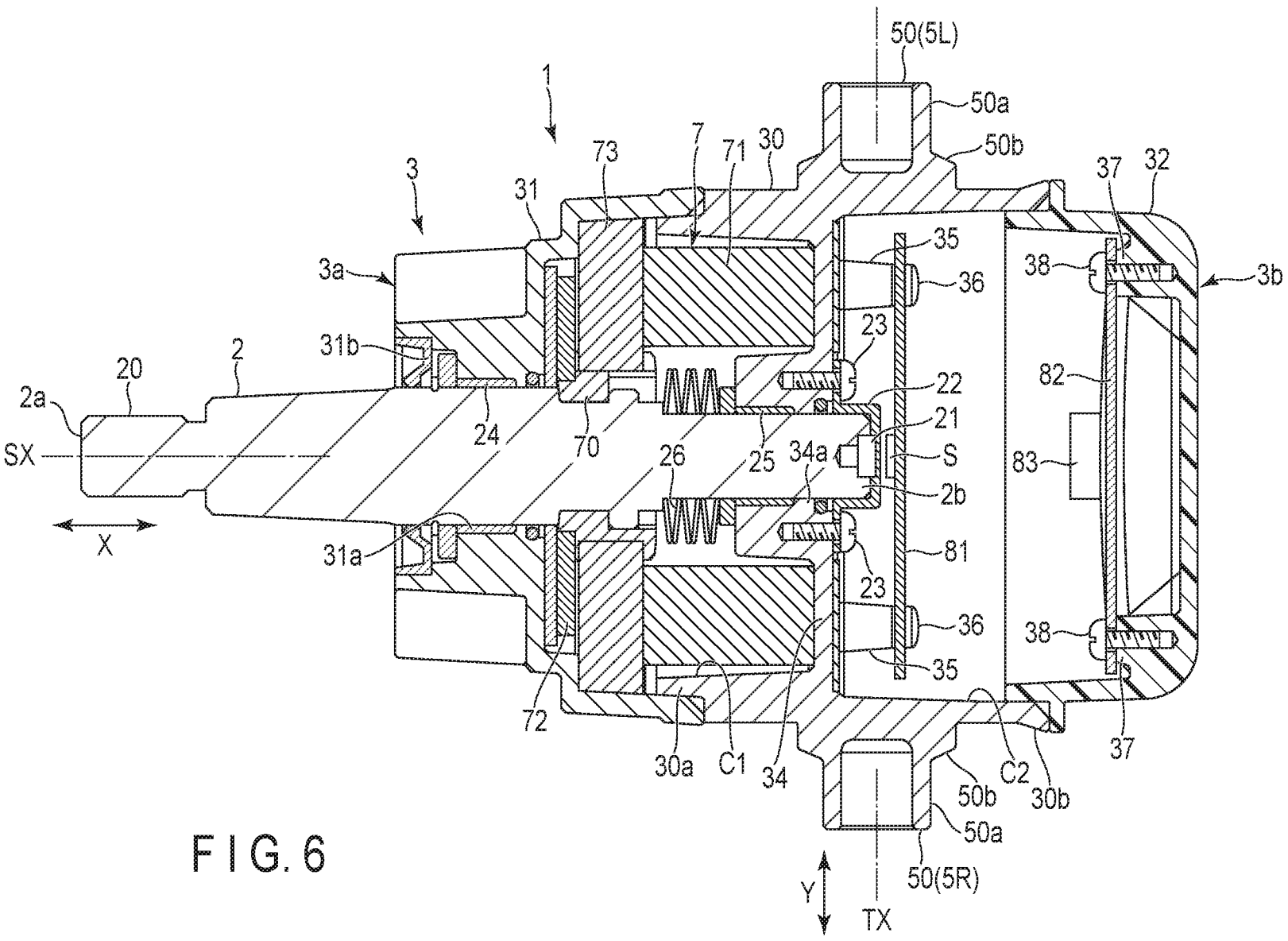
FIG. 6 is a schematic cross-sectional view of the helm device along line VI-VI in FIG. 3.
Figure 7:
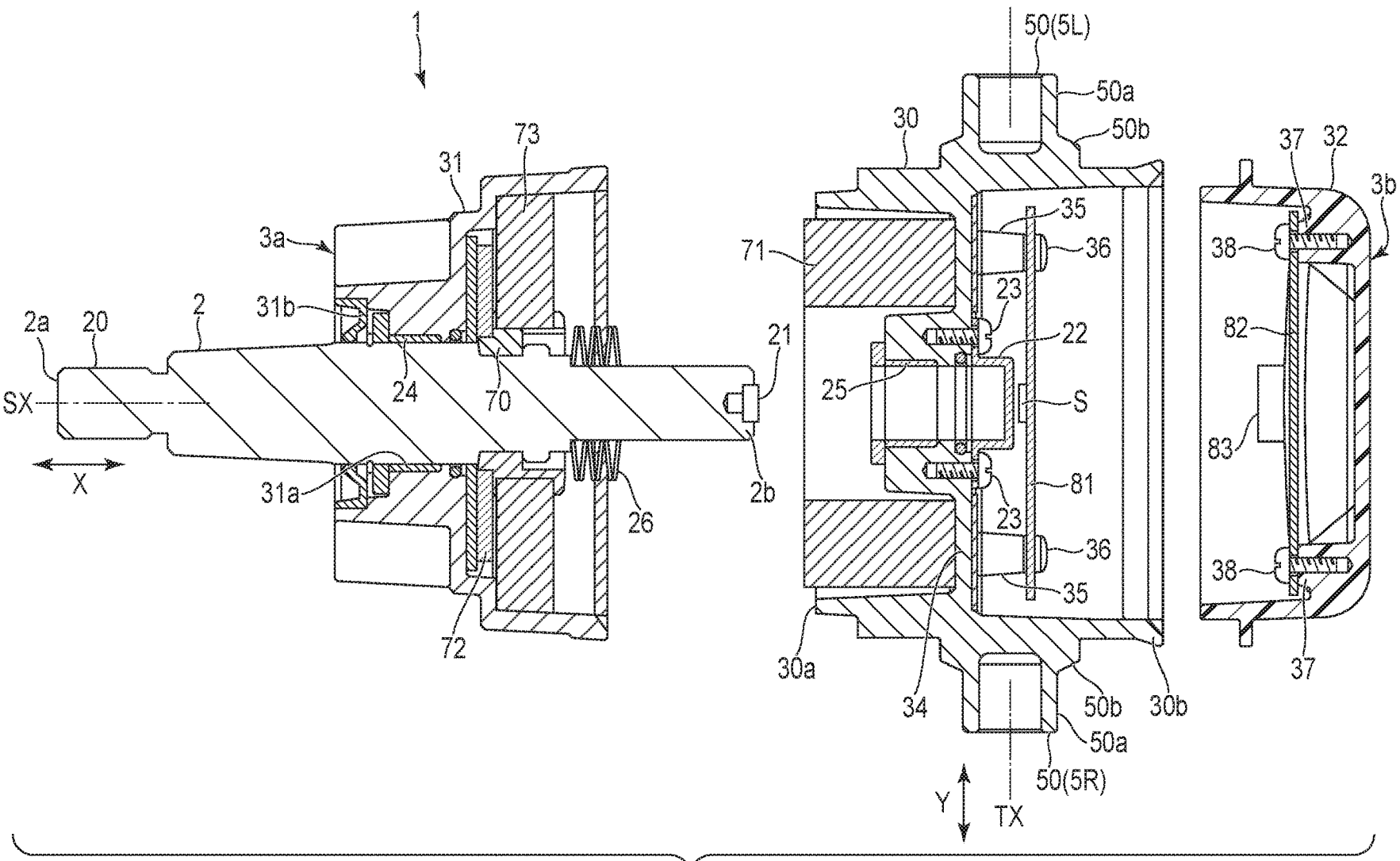
FIG. 7 is a schematic cross-sectional view of a state where a housing is disassembled in the helm device shown in FIG. 6.

FIG. 6 is a schematic cross-sectional view of the helm device 1 along line VI-VI in FIG. 3. FIG. 7 is a schematic cross-sectional view of a state where the housing 3 is disassembled in the helm device 1 shown in FIG. 6.

As shown in FIG. 6, the first end portion 30*a* of the housing base 30 is inserted into the inside of the housing top 31. In addition, part of the cover 32 is inserted into the inside of the second end portion 30*b* of the housing base 30.

The housing base 30 comprises a partition portion 34 in its inside. The partition portion 34 partitions the inside of the housing 3 into a first chamber C1 and a second chamber C2. The first chamber C1 is a space formed by the housing base 30 and the housing top 31. The second chamber C2 is a space formed by the housing base 30 and the cover 32.

The partition portion 34 comprises an opening 34*a*. The steering shaft 2 is passed through the opening 31*a* of the housing top 31 and the opening 34*a* of the partition portion 34. A back end portion 2*b* of the steering shaft 2, which is located inside the housing 3, is provided with a magnet 21. The back end portion 2*b* and the magnet 21 are covered by a cover 22. The cover 22 is, for example, coupled to the partition portion 34 by coupling members 23 which are, for example, screws.

The steering shaft 2 is rotatably supported by a bearing member 24 provided at the opening 31*a* and a bearing member 25 provided at the opening 34*a*. In the first chamber C1, an elastic member 26 which is, for example, a Belleville spring is disposed. The steering shaft 2 is urged by the elastic member 26 in a direction in which it projects from the housing 3 (left in FIG. 6 and FIG. 7). The elastic member 26 deforms when receiving a load in a direction along an axial line of the steering shaft 2, and thus also has the function of absorbing vibration in this direction.

For example, in the first chamber C1, oil is filled and an electromagnetic brake 7 is disposed. The electromagnetic brake 7 comprises a rotation member 70, an electromagnet 71, an armature 72, and a disk group 73.

The rotation member 70 is fixed to the steering shaft 2 and rotates with the steering shaft 2. The electromagnet 71 is fixed to the inside of the housing base 30 around the steering shaft 2. The armature 72 is disposed around the steering shaft 2 inside the housing top 31. The armature 72 is movable in the first direction X with respect to the steering shaft 2. The electromagnet 71 and the armature 72 are opposed in the first direction X.

The disk group 73 includes rotating disks and fixed disks. Tooth portions are formed on the inner circumferential portions of the rotating disks, and the tooth portions are fitted into splines formed on the outer circumferential surface of the rotation member 70. The rotating disks are thereby held by the rotation member 70 to be movable in the first direction X and rotate with the rotation member 70. Tooth portions are formed on the outer circumferential portions of the fixed disks, and the tooth portions are fitted into splines provided on a yoke of the electromagnet 71. The fixed disks are thereby held by the yoke to be movable in the first direction X and to be nonrotatable with respect to the housing top 31. The rotating disks and the fixed disks are alternately arranged in the first direction X between the electromagnet 71 and the armature 72.

The electromagnet 71 includes the above yoke and a coil. By magnetic force produced when the coil is supplied with power, the armature 72 is attracted to the yoke and the disk group 73 is pushed. At this time, in the disk group 73, the rotating disks and the fixed disks are pressed against each other, increasing friction force at the time when the steering shaft 2 is rotated.

The electromagnetic brake 7 like this can adjust resistance (steering effort) at the time when the steering shaft 2 and the steering wheel W are operated. For example, the resistance is set by the control unit 150 in accordance with the boat operator's request or the conditions under which the boat is operated. To increase the resistance, power supplied to the coil of the electromagnet 71 should be increased, and to decrease the resistance, the power should be decreased.

The control unit 150 may has the function of locking the steering shaft 2 to prevent the steering wheel W from further rotating when the steering wheel W has rotated from the neutral position to the maximum steering angle. That is, when the steering wheel W has rotated to the starboard side or the port side up to the maximum number of steering wheel rotations, the control unit 150 maximizes power supplied to the electromagnet 71. Consequently, the magnetic force of the electromagnet 71 is maximized, and the rotating disks and the fixed disks in the disk group 73 are locked together.

In the second chamber C2, a first circuit board 81 and a second circuit board 82 in the form of flat plates orthogonal to the first direction X are disposed. The first circuit board 81 is fixed to boss portions 35 provided on the partition portion 34 by coupling members 36 which are, for example, screws. The second circuit board 82 is fixed to boss portions 37 provided on the cover 32 by coupling members 38 which are, for example, screws.

The first circuit board 81 and the second circuit board 82 are opposed with a gap therebetween in the first direction X. The above-described sensor S is mounted on the first circuit board 81. The sensor S detects the rotation of the steering shaft 2 on the basis of magnetism produced by the magnet 21.

On the second circuit board 82, a power supply circuit 83 which supplies power to the electrical elements of the helm device 1, such as the first circuit board 81, the electromagnetic brake 7, and the sensor S, is mounted. The electromagnetic brake 7 and the power supply circuit 83, and the first circuit board 81 and the second circuit board 82 are connected by lines not shown in the figure. In addition, lines not shown in the figure for connecting to devices such as the control unit 150 and a battery which are disposed outside the housing 3 are connected to the first circuit board 81 and the second circuit board 82.

In this manner, since the two circuit boards 81 and 82 are disposed in the housing 3, the space for mounting various ICs and electronic components including the sensor S and the power supply circuit 83 can be secured widely. Moreover, if the circuit boards 81 and 82 are arranged in the first direction X, the widths in the second direction Y of the circuit boards 81 and 82, the second chamber C2, the housing 3, etc., can be made small.

In the examples of FIG. 6 and FIG. 7, in the second direction Y, the tilt axis TX is disposed at a position closer to the back end portion 3*b* than to the front end portion 3*a* of the housing 3. In the second direction Y, the back end portion 2*b* of the steering shaft 2 located inside the housing 3 overlaps each of the shaft members 50. In addition, the second chamber C2 and the first circuit board 81 also overlap each of the shaft members 50 in the second direction Y. The tilt axis TX extends through the space between the first circuit board 81 and the partition portion 34. The sensor S and the magnet 21 are located substantially on the tilt axis TX. The first chamber C1 is located closer to the front end portion 3*a* of the housing 3 than the tilt axis TX.

In the first direction X, each of the shaft members 50 is located closer to the back end portion 3*b* of the housing 3 than the electromagnetic brake 7. The second circuit board 82 does not overlap each of the shaft members 50 in the second direction Y and is located closer to the back end portion 3*b* than the first circuit board 81.

In general, the present embodiment can provide the helm device 1, which can adjust the tilt angle of the steering shaft 2 and has excellent functionality and operability. In the following description, the specific action and effects of the helm device 1 will be explained.

Figure 8:
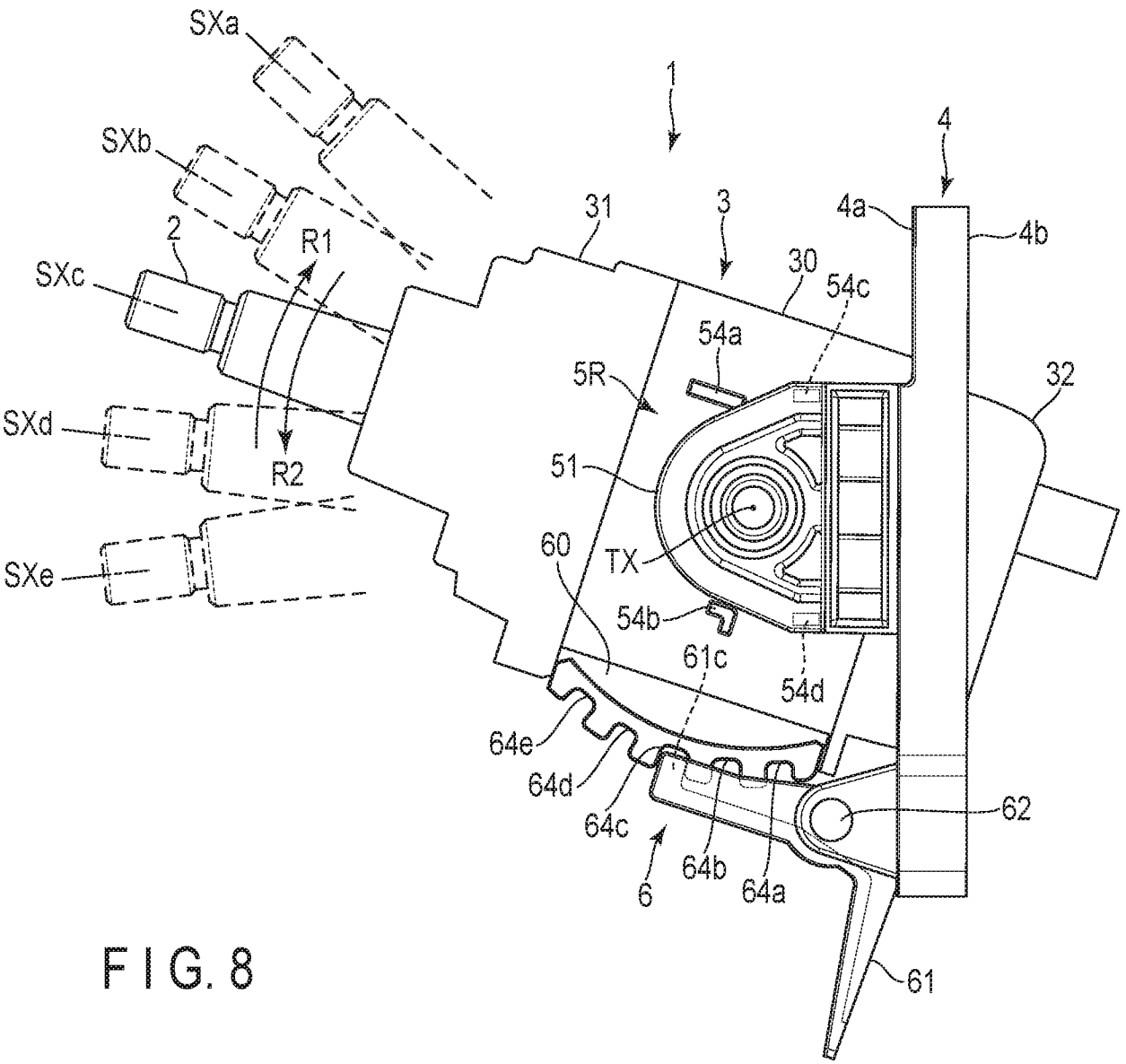
FIG. 8 is a schematic side view of the helm device shown in FIG. 3.

FIG. 8 is a schematic side view of the helm device 1. The five slots 64 of the lock mechanism 6 will be hereinafter referred to as slots 64*a*, 64*b*, 64*c*, 64*d*, and 64*e* as shown in FIG. 8.

In the example of FIG. 8, the latch 61*c* is inserted into the central slot 64*c*. In a state where the engagement between the latch 61*c* and the slots 64*a*, 64*b*, 64*c*, 64*d*, and 64*e* is released by operating the lever 61, the steering shaft 2 and the housing 3 can be rotated by the tilt mechanisms 5R and 5L on the tilt axis TX in a first rotation direction R1 and a second rotation direction R2 opposite to the first rotation direction R1. Moreover, the rotation by the tilt mechanisms 5R and 5L can be locked by inserting the latch 61*c* into any one of the slots 64*a*, 64*b*, 64*c*, 64*d*, and 64*e*. The shaft axes SX when the latch 61*c* is inserted into the slots 64*a*, 64*b*, 64*c*, 64*d*, and 64*e*, respectively, will be hereinafter referred to as shaft axes SXa, SXb, SXc, SXd, and SXe.

The shaft axis SXc is defined as a reference position of the steering shaft 2. Moreover, the angles formed by the shaft axes SXa, SXb, SXd, and SXe with respect to the shaft axis SXc are defined as tilt angles. The tilt angles correspond to the tilts of the steering shaft 2. The tilt angle of the shaft axis SXa corresponds to a first critical angle which can be set in the first rotation direction R1, and the tilt angle of the shaft axis SXe corresponds to a second critical angle which can be set in the second rotation direction R2.

For example, the tilt angle of the shaft axis SXa is +24°, the tilt angle of the shaft axis SXb is +12°, the tilt angle of the shaft axis SXd is −12°, and the tilt angle of the shaft axis SXe is −24°. However, the respective tilt angles of the shaft axes SXa, SXb, SXd, and SXe are not limited to this example. In addition, the tilt angles are not necessarily adjustable at equal angles (12° in the above example).

In a state where the engagement between the latch 61*c* and the slots 64*a*, 64*b*, 64*c*, 64*d*, and 64*e* is released by operating the lever 61, when the housing 3 is rotated in the first rotation direction R1 and the tilt angle thereby reaches +24° (first critical angle), which corresponds to the slot 64*a*, the first stopper 54*a* and the third stopper 54*c* are brought into contact with each other. The housing 3 is thereby stopped from further rotating in the first rotation direction R1.

In addition, when the housing 3 is rotated in the second rotation direction R2 and the tilt angle thereby reaches −24° (second critical angle), which corresponds to the slot 64*e*, the second stopper 54*b* and the fourth stopper 54*d* are brought into contact with each other. The housing 3 is thereby stopped from further rotating in the second rotation direction R2. Note that at least in a state where the tilt angle is in the range between the first critical angle and the second critical angle, the housing 3 does not contact the tilt base 4.

In this manner, the rotation of the housing 3 is stopped at the positions corresponding to the slots 64*a* and 64*e*, and the boat operator thereby can easily know the limit of tilt angle adjustment. In addition, since the housing 3 is not rotated beyond the first critical angle or the second critical angle, a collision of the tilt base 4 and the hull with the housing 3 can be prevented.

The first stopper 54*a* also has the function of receiving the arm 53*c* of the first urging member 53, as well as the function of stopping the housing 3 from further rotating in the first rotation direction R1 at the first critical angle. Accordingly, the structural elements of the helm device 1 can be reduced and the assembly of the helm device 1 is facilitated.

In the helm device 1 having the structure shown in FIG. 6, a lot of members are disposed closer to the front end portion 3*a* of the housing 3 than the tilt axis TX, so that the center of gravity of the helm device 1 is located closer to the front end portion 3*a* than the tilt axis TX as described above. Also in this case, the above-described first urging member 53 prevents the steering shaft 2 from tilting downward because of the weight of the housing 3, etc., in a state where the fixing of the housing 3 by the lock mechanism 6 is released.

The tilt axis TX is located between the tilt base 4 and the front end portion 2*a* of the steering shaft 2 in the first direction X. Furthermore, the tilt axis TX is located at a position closer to the back end portion 3*b* than to the front end portion 3*a* of the housing 3 in the first direction X. These reduce the amount by which the housing 3 projects more backward than the tilt base 4 and increase the degree of freedom of the structure of the hull to which the tilt base 4 is fixed.

In addition to the above-described effects, various favorable effects can be obtained from the present embodiment.

The present embodiment does not limit the scope of the present invention to the structure disclosed in the present embodiment. The present invention can be carried out by modifying the structure disclosed in the present embodiment into various forms.

For example, a means (stopper structure) for stopping the rotation of the housing 3 at the first critical angle and the second critical angle is not limited to the stoppers 54*a*, 54*b*, 54*c*, and 54*d*.

Figure 9:
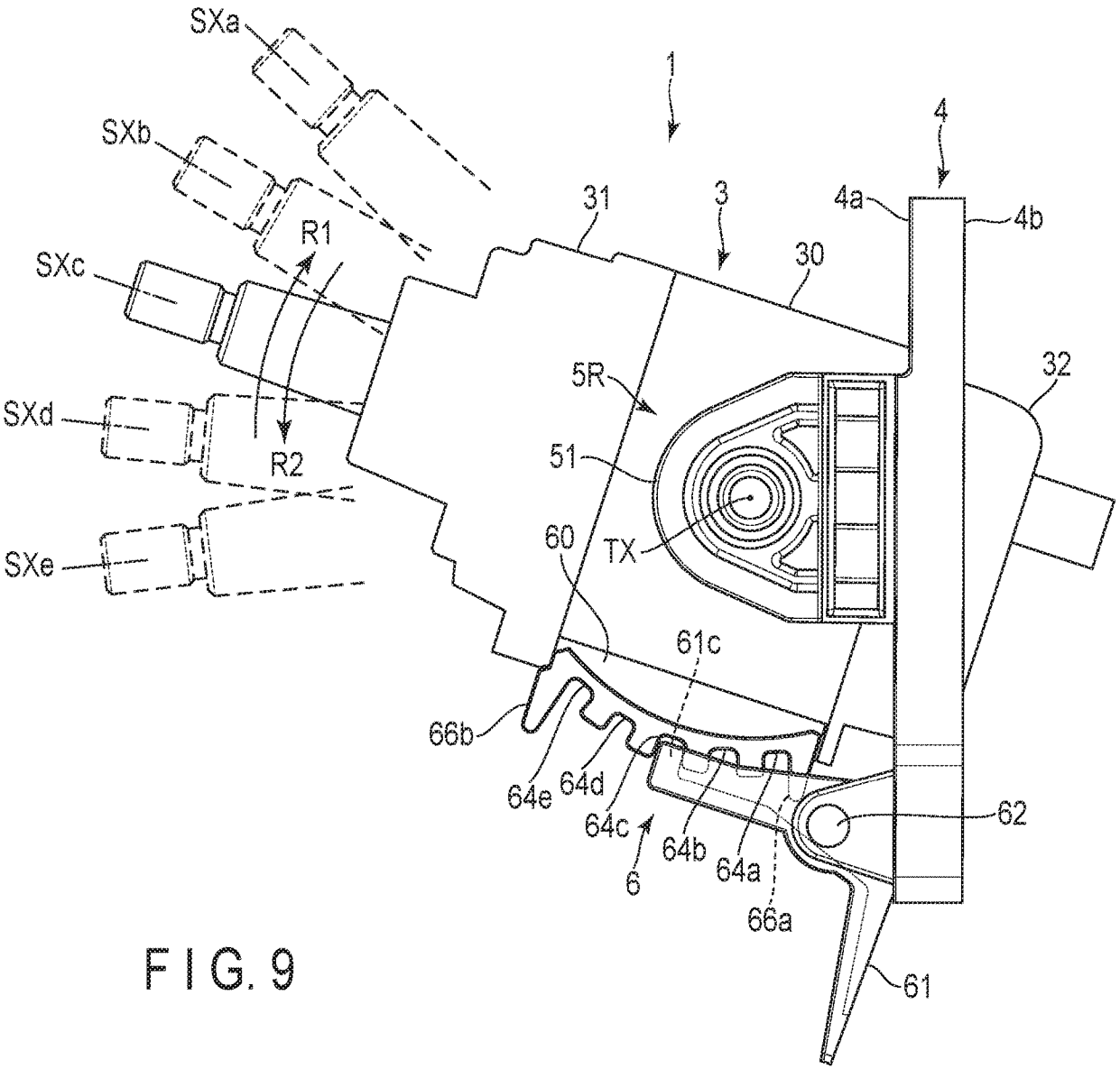
FIG. 9 is a schematic side view of the helm device according to a modified example.

FIG. 9 is a schematic side view of the helm device 1 according to a modified example. In the example of this figure, the lock mechanism 6 comprises a fifth stopper 66*a* and a sixth stopper 66*b*. The helm device 1 may further comprise the above-described stoppers 54*a*, 54*b*, 54*c*, and 54*d* in addition to the fifth stopper 66*a* and the sixth stopper 66*b*.

The fifth stopper 66*a* and the sixth stopper 66*b* are located at both ends of the slots 64*a*, 64*b*, 64*c*, 64*d*, and 64*e*, respectively, in a circumferential direction having its center on the tilt axis TX. The fifth stopper 66*a* and the sixth stopper 66*b* project downward sufficiently longer than the portions between the slots 64*a*, 64*b*, 64*c*, 64*d*, and 64*e* of the arcuate portion 60. For example, the fifth stopper 66*a* and the sixth stopper 66*b* have such a length that they contact the latch 61*c* when the housing 3 is rotated about the tilt axis TX even in a state where the lever 61 is pushed to move the latch 61*c* farthest away from the arcuate portion 60.

In a state where the engagement between the latch 61*c* and the slots 64*a*, 64*b*, 64*c*, 64*d*, and 64*e* is released by operating the lever 61, when the housing 3 is rotated in the first rotation direction R1 and the tilt angle thereby reaches +24° (first critical angle), which corresponds to the slot 64*a*, the fifth stopper 66*a* and the latch 61*c* are brought into contact with each other. The housing 3 is thereby stopped from further rotating in the first rotation direction R1.

In addition, when the housing 3 is rotated in the second rotation direction R2 and the tilt angle thereby reaches −24° (second critical angle), which corresponds to the slot 64*e*, the sixth stopper 66*b* and the latch 61*c* are brought into contact with each other. The housing 3 is thereby stopped from further rotating in the second rotation direction R2.

The fifth stopper 66*a* and the sixth stopper 66*b* as described above also can stop the housing 3 from rotating beyond the first critical angle and the second critical angle.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A helm device of a boat, comprising:

a steering shaft extending in a first direction;

a housing in which part of the steering shaft is housed;

a tilt base mounted on a hull;

a pair of tilt mechanisms which supports the housing to make the housing rotatable with respect to the tilt base about a tilt axis parallel to a second direction crossing the first direction;

a lock mechanism which fixes an angle of the steering shaft with respect to the tilt base by stopping the housing from being rotated by the pair of tilt mechanisms, and an electromagnetic brake which is housed in the housing and which gives resistance to the steering shaft, wherein:

each of the pair of tilt mechanisms comprises:

a shaft member projecting from a side portion of the housing crossing the tilt axis;

a bracket provided on the tilt base and comprising a hole portion into which the shaft member is inserted rotatably; and a bushing disposed between an outer circumferential surface of the shaft member and an inner circumferential surface of the hole portion, a center of gravity of the main body of the helm device including the steering shaft, the electromagnetic brake, and the housing is located closer to a front end portion of the steering shaft than the tilt axis, the housing comprises a front end portion through which the steering shaft extends and a back end portion located opposite to the front end portion in the first direction, and the shaft member is located closer to the back end portion than the electromagnetic brake in the first direction.

2. The helm device of claim 1, wherein:

the tilt base comprises an opening, the housing passes through the opening, the bracket projects from the tilt base toward the front end portion of the steering shaft, and the tilt axis is located between the tilt base and the front end portion of the steering shaft in the first direction.

3. The helm device of claim 1, wherein:

each of the pair of tilt mechanisms further comprises a first urging member which urges the housing in a predetermined rotation direction around the tilt axis, and the first urging member comprises a coil portion through which the shaft member is passed, an arm on a fixed-point side which extends from the coil portion and which is supported by the tilt base, and an arm on a point-of-action side which extends from the coil portion and which is supported by the housing.

4. The helm device of claim 1, wherein:

the lock mechanism comprises:

slots on an outer surface of the housing which are arranged in a circumferential direction around the tilt axis; and a lever comprising a latch which is insertable into the slots, and when the latch is inserted into any one of the slots, the housing is stopped from being rotated by the pair of tilt mechanisms.

5. The helm device of claim 4, wherein:

the lock mechanism further comprises:

a pin which couples the lever to the tilt base to make the lever rotatable about an axis parallel to the tilt axis; and a second urging member which urges the lever to press the latch against the slots, and the second urging member comprises a coil portion through which the pin is passed, an arm on a fixed-point side which extends from the coil portion and which is supported by the tilt base, and an arm on a point-of-action side which extends from the coil portion and which is supported by the lever.

6. The helm device of claim 1, wherein:

each of the pair of tilt mechanisms further comprises:

a first stopper and a second stopper provided on the housing around the shaft member and arranged in a circumferential direction around the tilt axis; and a third stopper and a fourth stopper provided on the bracket and arranged concentrically with the first stopper and the second stopper, when the housing is rotated in a first rotation direction around the tilt axis and a tilt of the steering shaft thereby reaches a first critical angle, the first stopper and the third stopper are brought into contact with each other and the housing is stopped from further rotating in the first rotation direction, and when the housing is rotated in a second rotation direction opposite to the first rotation direction and the tilt of the steering shaft thereby reaches a second critical angle, the second stopper and the fourth stopper are brought into contact with each other and the housing is stopped from further rotating in the second rotation direction.

7. The helm device of claim 4, wherein:

the lock mechanism further comprises a fifth stopper and a sixth stopper located at ends of the slots in a circumferential direction around the tilt axis, respectively, in a state where the latch is retracted from the slots, when the housing is rotated in a first rotation direction around the tilt axis and a tilt of the steering shaft thereby reaches a first critical angle, the fifth stopper and the latch are brought into contact with each other and the housing is stopped from further rotating in the first rotation direction, and in a state where the latch is retracted from the slots, when the housing is rotated in a second rotation direction opposite to the first rotation direction and the tilt of the steering shaft thereby reaches a second critical angle, the sixth stopper and the latch are brought into contact with each other and the housing is stopped from further rotating in the second rotation direction.

8. The helm device of claim 1, wherein an end portion of the steering shaft located inside the housing overlaps the shaft member in a direction parallel to the tilt axis.

9. The helm device of claim 1, further comprising:

a first circuit board on which a sensor is mounted, the sensor detecting rotation of the steering shaft; and a second circuit board on which a power supply circuit is mounted, the power supply circuit supplying power to the first circuit board, wherein:

the first circuit board overlaps the shaft member in the second direction, and the second circuit board is located between the first circuit board and the back end portion in the first direction.

10. The helm device of claim 9, wherein:

the housing comprises:

a housing base comprising a first end portion in the first direction, a second end portion opposite to the first end portion, and the shaft member of each of the pair of tilt mechanisms;

a housing top coupled to the first end portion of the housing base and provided with an opening through which the steering shaft is passed; and a cover coupled to the second end portion of the housing base, the housing base and the housing top form a first chamber in which part of the steering shaft and the electromagnetic brake are housed, the housing base and the cover form a second chamber in which the first circuit board and the second circuit board are housed, and the second chamber overlaps the shaft member in the second direction.

* * * * *